US008069920B2

(12) United States Patent
Cronley et al.

(10) Patent No.: US 8,069,920 B2
(45) Date of Patent: Dec. 6, 2011

(54) LATERAL WELL LOCATOR AND REENTRY APPARATUS AND METHOD

(75) Inventors: Gerald J. Cronley, Gretna, LA (US); Timothy T. Torrez, Aztec, NM (US)

(73) Assignee: Knight Information Systems, L.L.C., Lafayette, LA (US)

( * ) Notice: Subject to any disclaimer, the term of this patent is extended or adjusted under 35 U.S.C. 154(b) by 211 days.

(21) Appl. No.: 12/417,170

(22) Filed: Apr. 2, 2009

(65) Prior Publication Data

US 2010/0252275 A1 Oct. 7, 2010

(51) Int. Cl.

| | |
|---|---|
| ***E21B 47/022*** | (2006.01) |
| ***E21B 7/06*** | (2006.01) |
| ***E21B 17/046*** | (2006.01) |
| ***E21B 43/14*** | (2006.01) |
| ***E03B 3/14*** | (2006.01) |

(52) U.S. Cl. ..... 166/255.3; 166/169; 166/117.5; 166/242.5; 166/50; 166/313

(58) Field of Classification Search ..... 166/50, 166/117.5, 117.6, 79, 81, 255.3, 169, 242.5, 166/313

See application file for complete search history.

(56) References Cited

U.S. PATENT DOCUMENTS

| | | | | | |
|---|---|---|---|---|---|
| 3,561,535 | A | * | 2/1971 | Butler et al. | 166/381 |
| 3,610,336 | A | * | 10/1971 | Sizer | 166/117.6 |
| 3,713,483 | A | * | 1/1973 | Robicheaux | 166/117.5 |
| 4,074,762 | A | * | 2/1978 | Parker et al. | 166/385 |
| 4,103,740 | A | * | 8/1978 | Yonker | 166/117.5 |
| 4,153,109 | A | * | 5/1979 | Szescila | 166/382 |
| 4,182,423 | A | * | 1/1980 | Ziebarth et al. | 175/61 |
| 4,194,580 | A | * | 3/1980 | Messenger | 175/61 |
| 4,284,136 | A | * | 8/1981 | Grabe | 166/117.5 |
| 4,304,299 | A | * | 12/1981 | Holland et al. | 166/255.3 |
| 4,321,965 | A | * | 3/1982 | Restarick et al. | 166/117.5 |
| 4,365,668 | A | * | 12/1982 | Bright | 166/214 |
| 4,449,595 | A | * | 5/1984 | Holbert | 175/79 |
| 4,665,995 | A | * | 5/1987 | Braithwaite et al. | 175/45 |
| 4,693,327 | A | * | 9/1987 | Dickinson et al. | 175/61 |
| 4,742,871 | A | * | 5/1988 | Miffre | 166/117.5 |
| 4,762,186 | A | * | 8/1988 | Dech et al. | 175/61 |
| 4,807,704 | A | * | 2/1989 | Hsu et al. | 166/313 |
| 4,819,760 | A | * | 4/1989 | Petermann | 181/102 |
| 4,928,767 | A | * | 5/1990 | Jelsma | 166/377 |
| 5,109,924 | A | * | 5/1992 | Jurgens et al. | 166/117.5 |
| 5,113,938 | A | * | 5/1992 | Clayton | 166/117.6 |

(Continued)

OTHER PUBLICATIONS

"head." Merriam-Webster Online Dictionary. 2011. Merriam-Webster Online. May 18, 2011 <http://www.merriam-webster.com/dictionary/head?show=0&t=1305809465>.*

(Continued)

*Primary Examiner* — Shane Bomar
*Assistant Examiner* — Kelly Shaw
(74) *Attorney, Agent, or Firm* — Jones Walker

(57) ABSTRACT

A down-hole assembly used to locate an existing window in a main cased well bore and guide equipment through the window and into a lateral well bore after removal of a whip stock. The assembly includes a running tool with a convex section detachably connected to a concave section of a guide member. The running tool includes a window locator that locates the window. The guide member includes an inclined or wedge shaped portion for guiding tools or equipment through the window and into the lateral well bore so that remedial work can be carried out.

36 Claims, 11 Drawing Sheets

U.S. PATENT DOCUMENTS 5,131,467 A * 7/1992 Osborne et al. ..... 166/117.6
5,188,190 A * 2/1993 Skaalure ..... 175/58
5,193,620 A * 3/1993 Braddick ..... 166/382
5,195,591 A * 3/1993 Blount et al. ..... 166/380
5,269,374 A * 12/1993 Taylor ..... 166/255.2
5,277,251 A * 1/1994 Blount et al. ..... 166/117.5
5,311,936 A * 5/1994 McNair et al. ..... 166/50
5,318,122 A * 6/1994 Murray et al. ..... 166/313
5,318,132 A * 6/1994 Odorisio ..... 166/382
5,341,873 A * 8/1994 Carter et al. ..... 166/117.5
5,346,017 A * 9/1994 Blount et al. ..... 166/380
5,394,950 A * 3/1995 Gardes ..... 175/45
5,409,060 A * 4/1995 Carter ..... 166/237
5,425,417 A * 6/1995 Carter ..... 166/117.6
5,425,425 A * 6/1995 Bankston et al. ..... 166/377
5,427,177 A * 6/1995 Jordan et al. ..... 166/50
5,431,219 A * 7/1995 Leising et al. ..... 166/50
5,431,223 A * 7/1995 Konopczynski ..... 166/117.5
5,458,209 A * 10/1995 Hayes et al. ..... 175/61
5,488,989 A * 2/1996 Leising et al. ..... 166/255.3
5,533,573 A * 7/1996 Jordan et al. ..... 166/313
5,564,503 A * 10/1996 Longbottom et al. ..... 166/313
5,566,762 A * 10/1996 Braddick et al. ..... 166/382
5,592,991 A * 1/1997 Lembcke et al. ..... 166/298
5,651,415 A * 7/1997 Scales ..... 166/250.09
5,678,634 A * 10/1997 Rehbock et al. ..... 166/377
5,697,445 A * 12/1997 Graham ..... 166/313
5,803,176 A * 9/1998 Blizzard et al. ..... 166/298
5,810,080 A * 9/1998 Meynier ..... 166/66
5,836,387 A * 11/1998 Carter ..... 166/217
5,862,859 A * 1/1999 Speed et al. ..... 166/117.5
5,871,046 A * 2/1999 Robison ..... 166/241.1
5,884,698 A * 3/1999 Hughes et al. ..... 166/117.6
5,887,655 A * 3/1999 Haugen et al. ..... 166/298
5,909,770 A * 6/1999 Davis ..... 166/117.6
5,911,275 A * 6/1999 McGarian et al. ..... 166/117.6
5,947,201 A * 9/1999 Ross et al. ..... 166/298
6,003,621 A * 12/1999 Murray ..... 175/79
6,012,527 A * 1/2000 Nitis et al. ..... 166/313
6,024,169 A * 2/2000 Haugen ..... 166/298
6,032,740 A * 3/2000 Schnitker et al. ..... 166/298
6,035,939 A * 3/2000 Carter ..... 166/382
6,050,334 A * 4/2000 McGarian et al. ..... 166/117.6
6,076,606 A * 6/2000 Bailey et al. ..... 166/382
6,102,123 A * 8/2000 Bailey et al. ..... 166/313
6,142,225 A * 11/2000 McCorry et al. ..... 166/117.6
6,173,796 B1 * 1/2001 McLeod ..... 175/257
6,186,233 B1 * 2/2001 Brunet ..... 166/298
6,199,635 B1 * 3/2001 Brunet et al. ..... 166/255.2
6,209,635 B1 * 4/2001 Gotlib et al. ..... 166/117.5
6,244,340 B1 * 6/2001 McGlothen et al. ..... 166/255.3
6,279,659 B1 * 8/2001 Brunet ..... 166/313
6,315,044 B1 * 11/2001 Tinker ..... 166/298
6,315,054 B1 * 11/2001 Brunet ..... 166/387
6,334,485 B1 * 1/2002 George ..... 166/50
6,360,821 B1 * 3/2002 Braddick ..... 166/117.6
6,405,804 B1 * 6/2002 Ohmer et al. ..... 166/377
6,422,312 B1 * 7/2002 Delatorre et al. ..... 166/250.15
6,457,525 B1 * 10/2002 Scott ..... 166/300
6,619,400 B2 * 9/2003 Brunet ..... 166/313
6,679,329 B2 * 1/2004 Murray et al. ..... 166/313
6,695,056 B2 * 2/2004 Haugen et al. ..... 166/297
6,702,014 B1 * 3/2004 McGarian et al. ..... 166/117.6
6,935,431 B2 * 8/2005 Dewey et al. ..... 166/382
6,968,896 B2 * 11/2005 Coon ..... 166/117.6
6,968,903 B2 * 11/2005 Pollard ..... 166/382
7,178,589 B2 * 2/2007 Campbell et al. ..... 166/216
7,331,387 B2 * 2/2008 McGarian et al. ..... 166/255.3
7,422,057 B2 * 9/2008 Lewis et al. ..... 166/117.5
7,448,446 B2 * 11/2008 Campbell et al. ..... 166/216
7,455,110 B2 11/2008 Lynde
2002/0023745 A1 * 2/2002 George et al. ..... 166/50
2002/0066577 A1 * 6/2002 Dewey et al. ..... 166/382
2002/0074121 A1 * 6/2002 Schick ..... 166/313
2002/0096326 A1 * 7/2002 Buytaert ..... 166/255.3
2002/0100588 A1 * 8/2002 Murray et al. ..... 166/313
2002/0195243 A1 * 12/2002 Hart et al. ..... 166/117.6
2003/0070801 A1 * 4/2003 Harmon et al. ..... 166/117.5
2003/0075334 A1 * 4/2003 Haugen et al. ..... 166/313
2003/0150612 A1 * 8/2003 McGarian et al. ..... 166/255.3
2003/0192700 A1 * 10/2003 Murray et al. ..... 166/313
2009/0255664 A1 * 10/2009 Hart et al. ..... 166/117.6
2010/0059279 A1 * 3/2010 Saylor ..... 175/40

OTHER PUBLICATIONS

Search Report, Aug. 11, 2011, Cronely et al., PCT/US11/035833.
Written Opinion, Aug. 11, 2011, Cronely et al., PCT/US11/035833.

* cited by examiner

LATERAL WELL LOCATOR AND REENTRY APPARATUS AND METHOD

FIELD OF THE INVENTION

The present invention relates to a lateral well locating and reentry apparatus and method, and more particularly to an apparatus and method for locating a window in a main well and reinstalling a guide for reentry through the window and into a lateral well.

BACKGROUND OF THE INVENTION

In the exploration for oil and gas, a main well bore is drilled and cased. The well bore may be a vertical or horizontal well. It is often necessary to drill one or more lateral wells off of the main well bore. These lateral wells are usually drilled to increase production from the producing zone or enter new zones which may contain a hydrocarbon reservoir. To drill a lateral well, a whip stock is run into the main well bore on a work string and anchored at a location where the lateral well is to be drilled. The upper end of the whip stock has an inclined face. A milling bit on a tubular is diverted by the whip stock's inclined face into the casing wall where a window or opening in the casing is made for a lateral exit from the main well bore. The whip stock may be removed from the well bore after the lateral has been completed.

After removal of the whip stock, the need may arise to reenter a lateral well to clean it out or conduct remedial work. The present invention provides a reliable, cost-effective means to locate and reenter a lateral well bore after the whip stock has been removed from the main well bore.

SUMMARY OF THE INVENTION

It is an object of the present invention to provide a down-hole assembly and method capable of locating a window in a well bore.

It is a further object of the present invention to provide a down-hole assembly and method capable of determining the dimension and shape of a window in a well bore.

It is a further object of the present invention to provide a down-hole assembly and method capable of reinstalling a guide for reentry through a window into a lateral well bore.

It is a further object of the present invention to provide a down-hole assembly and method capable of the combined procedure of locating a window and guiding reentry of a down-hole tool through the window into a lateral well bore after a whip stock has been removed.

These and other objects and advantages of the present invention are achieved by a novel down-hole assembly for locating a window and reentering a lateral well bore in a main well bore after removal of a whip stock. The down-hole assembly may include a running tool having an upper section, a middle section and a lower section. The running tool may include a window locator for locating the window in the main well bore which leads to the lateral well bore. The assembly may also include a guide member having an upper section, a middle section and a lower section. The guide member may have a wedged-shaped outer surface for diverting a down-hole tool through the window and into the lateral well bore. The lower section of the running tool and the upper section of the guide member may each be shaped to receive the other in mating relationship. The lower section of the running tool and the upper section of the guide member may be capable of being detachably connected. When detachably connected, the running tool and the guide member may be in fluid communication.

The window locator in the running tool may include a pivoting arm and a window locating head. The running tool may also have biasing means operatively associated with the window locator. The biasing means may exert a force on the pivoting arm of the window locator to bias the window locating head in a direction external of the running tool. The window locating head may have a run-in position, a retracted position, and a window locating position. In the run-in position, the window locating head is positioned between the retracted and window locating positions and held stationary. The running tool may include one or more shear pins affixed to the window locator. The shear pins maintain the window locating head in the stationary position until sheared. In the retracted position, the window locating head is positioned substantially within the running tool. The window locating head may be held in the retracted position by the main well bore. In the window locating position, the window locating head may be biased in a direction external of the running tool with a portion of the window locating head positioned within the window.

The running tool may include a block means for restricting a maximum outward pivoting angle of the window locating head. The block means may have a shoulder capable of receiving an outer edge surface of the window locating head.

The running tool may include a stop means for preventing retraction of the window locating head from the window locating position. The stop means may comprise one or more spring-loaded shear pins. The one or more spring loaded shear pins may be actuated by displacement of the window locating head from the retracted position to the window locating position and deactivated by a shearing force. The deactivation may result in the window locating head returning to the retracted position.

The upper section of the running tool may have a first internal fluid passage bore and the lower section of the running tool may have a second internal fluid passage bore. The first and second internal fluid passage bores may be fluidly connected by a conduit. The conduit may by-pass the window locator.

The shape of the lower end of the running tool (or a portion thereof) may be substantially convex. The shape of the upper end of the guide member (or a portion thereof) may be substantially concave. The lower section of the running tool and the upper section of the guide member may be detachably connected by a shear bolt. The lower section of the running tool and the upper end of the guide member may be further detachably connected by a dovetail joint.

The guide member may include an internal fluid passage bore. The running tool may include a stinger pipe fluidly connected to the second internal fluid passage bore. The stinger pipe may be sealingly connected to the internal fluid passage bore of the guide member when the running tool and the guide member are detachably connected.

The guide member may also include a retrieval means. The retrieval means may provide a point of operative attachment for a retrieval or fishing tool for retrieval of the guide member.

In an alternative embodiment, the down-hole assembly may include a diverter sub having an upper end and a lower end. The upper end of the diverter sub may be operatively connected to a tubular. The assembly may also include a running tool having an upper section a middle section and a lower section. The upper section of the running tool may be operatively connected to the lower end of the diverter sub. The running tool may have a window locator for locating a window in a main cased well bore. The upper section of the running tool may include a first internal fluid passage bore. The lower section of the running tool may include a second internal fluid passage bore. The running tool may also have a conduit fluidly connecting the first and second internal fluid passage bores. The assembly may also include a guide member having an upper section, a middle section and a lower section. The lower section of the running tool and the upper section of the guide member may each be shaped to receive the other in mating relationship. The guide member may have an internal fluid passage bore. The upper section of the guide member may be detachably connected to the lower section of the running tool. The guide member may have a wedged-shaped outer surface for diverting a down-hole tool through the window and into the lateral well bore. The assembly may also have a stinger pipe with an upper end and a lower end. The upper end of the stinger pipe may be sealingly connected to the second internal fluid passage bore in the lower end of the running tool. The lower end of the stinger pipe may be sealingly connected to the internal fluid passage bore of the guide member. The assembly may also include a debris sub having an upper end and a lower end. The upper end of the debris sub may be operatively connected to the lower section of the guide member. The debris sub may include an internal fluid passage bore in fluid communication with the internal fluid passage bore of the guide member. The assembly may also include an anchor sub having an upper end and a lower end. The upper end of the anchor sub may be operatively connected to the lower end of the debris sub. The anchor sub may include an internal fluid passage bore fluidly connected to the internal fluid passage bore of the debris sub. The anchor sub may have anchor means for detachably affixing the anchor sub to the main cased well bore.

The tubular may be a work string, drill pipe or coiled tubing. If the tubular is coiled tubing, the down-hole assembly may further comprise an indexing tool.

In the alternative embodiment, the window locator may comprise a pivoting arm and a window locating head. The running tool may include a biasing means operatively associated with the window locator. The biasing means may exert a force on the pivoting arm of the window locator to bias the window locating head in a direction external of the running tool. The window locating head may have a run-in position, a retracted position, and a window locating position. In the run-in position, the window locating head may be positioned between the retracted and the window locating positions and held stationary. In the run-in position, the window locating head may be partially positioned external of the running tool for engagement with the main cased well bore or a smaller internal diameter section of the main cased well bore.

In the alternative embodiment, the shape of the lower end of the running tool (or a portion thereof) may be convex. The shape of the upper end of the guide member (or a portion thereof) may be concave. The lower section of the running tool and the upper section of the guide member may be detachably connected by a shear bolt. The lower section of the running tool and the upper end of the guide member may be further detachably connected by a dovetail joint. The running tool may include one or more shear pins affixed to the window locator. The shear pins maintain the window locating head in the stationary position until sheared. In the retracted position, the window locating head is positioned substantially within the running tool. The window locating head may be held in the retracted position by the main cased well bore or more particularly, the inner wall of the main cased well bore. In the window locating position, the window locating head may be biased in a direction external of the running tool with a portion of the window locating head positioned within the window.

The running tool of the alternative embodiment may also include a block means for restricting a maximum outward pivoting angle of the window locating head. The block means may be L-shaped and have a shoulder capable of receiving an outer edge surface of the window locating head.

The running tool of the alternative embodiment may also include stop means for preventing retraction of the window locating head from the window locating position. The stop means may comprise one or more spring-loaded shear pins. The one or more spring loaded shear pins may be actuated by displacement of the window locating head from the retracted position to the window locating position and deactivated by a shearing force. The deactivation may result in the window locating head returning to the retracted position.

The guide member of the alternative embodiment may include a retrieval means. The retrieval means may provide a point of operative attachment for a fishing tool.

The present invention is also directed to a method of locating a window and reentering a lateral well bore in a main well bore from which a whip stock has been removed. The main well bore may be a cased well. The method may include the step of deploying a tubular down the main well bore. The tubular may be a work string such as drill pipe or coiled tubing. The tubular may contain a down-hole assembly. The down-hole assembly may include a running tool having an upper section, a middle section and a lower section. The running tool may include a window locator for locating the window. The assembly may also have a guide member with an upper section, a middle section and a lower section. The guide member may have a wedged-shaped outer surface for diverting a down-hole tool through the window and into the lateral well bore. The lower section of the running tool and the upper section of the guide member may each be shaped to receive the other in mating relationship. The lower section of the running tool and the upper section of the guide member may be capable of being detachably connected. When detachably connected, the running tool and the guide member are in fluid communication.

The method may also includes the step of activating the window locator so that the window locator is able to reposition to a window locating position external of the running tool when the running tool is placed adjacent the window. The method may further include the step of causing the window locator to reposition to the window locating position by placing the running tool adjacent the window. The method may involve the step of maintaining the window locator in the window locating position. The method may include the steps of determining the dimensions of the window (e.g., determining an upper edge of the window and a lower edge of said window) and positioning the guide member, and more particularly the wedge-shaped portion of the guide member, adjacent the window. The method may further include the step of anchoring the guide member in the main cased well bore. The method may also involve detaching the running tool from the guide member and pulling the running tool out of the main cased well bore. The method may then proceed with the steps of deploying a second tubular containing a down-hole tool down the main cased well bore, through the window, and into the lateral well bore. The wedged-shaped outer surface of the guide member may act to divert the down-hole tool from the main cased well bore, through the window, and into the lateral well bore.

The method of the present involve may further comprise the step of causing the down-hole tool to perform remedial work on the lateral well bore. The method may additionally include the steps of deploying a third tubular containing a fishing tool down the main cased well bore, connecting the fishing tool to the guide member, disengaging the guide member from the main cased well bore, and pulling the guide member out of the main cased well bore.

The down-hole assembly and method of the present invention eliminate the need for running a caliper log to determine the position and shape of the window. Once the down-hole assembly, is set in place about the window, the well is restored to the same configuration that the well had before the whip stock was removed. The down-hole assembly permits drill bits, mill bits, work strings, and even tools with shoulders to be run in and out of the window without fear of dislodging the concave member (i.e., the guide member). The down-hole assembly also allows the window to be reamed out with one or more mills without causing the concave member to drop down-hole. Once work on the lateral well bore is completed, the down-hole assembly may be easily removed from the well bore with a retrieving tool.

The down-hole assembly is a reliable, cost-effective tool to locate and reenter an existing window in a cased well. The down-hole assembly may be used to clean-out a lateral well bore such as a horizontal leg, to restore production. The down-hole assembly may also be used to re-drill a lateral well. It could also be used to install a liner in an existing lateral. The down-hole assembly may be used for any type of remedial work where a reliable guide in and out of an existing window is required.

DETAILED DESCRIPTION OF PREFERRED EMBODIMENTS

Figure 1:
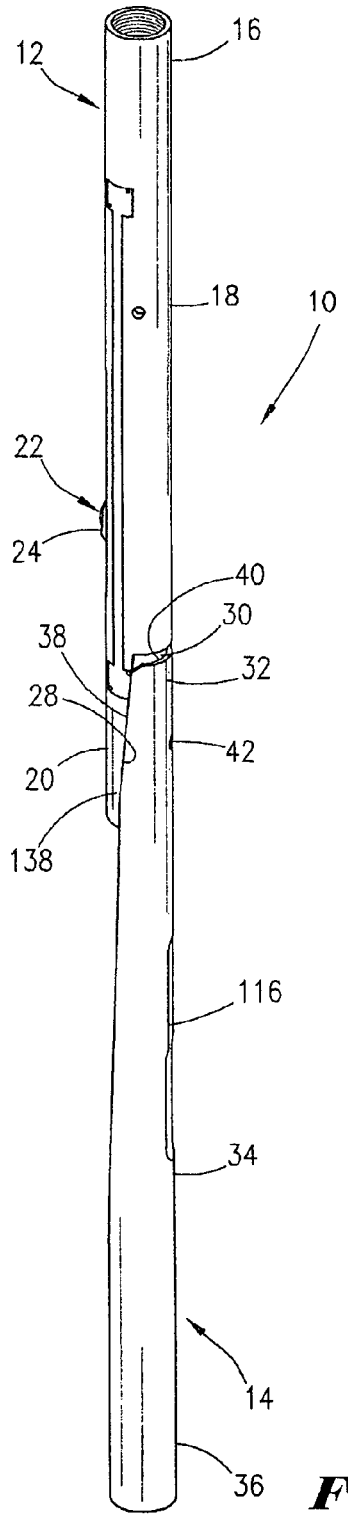
FIG. 1 is a perspective view of the running tool and guide member components of the down-hole assembly.
Figure 2:
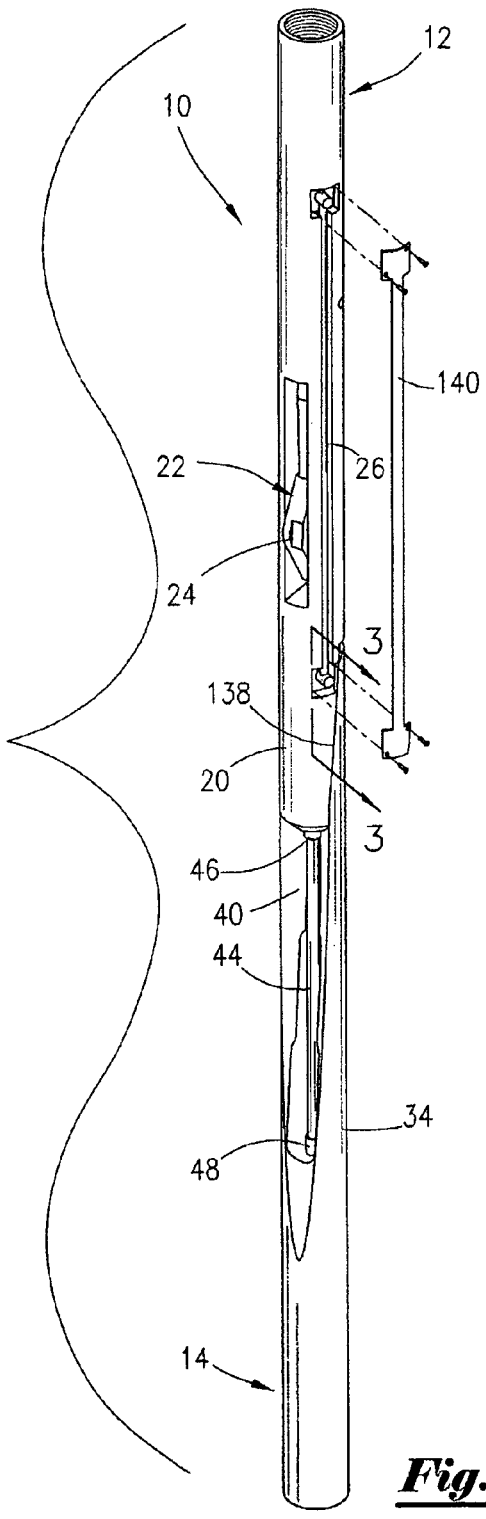
FIG. 2 is another perspective, partially exploded view of the running tool and guide member components shown in FIG. 1.

FIGS. 1 and 2 illustrate the present invention and show down-hole assembly 10 as including running tool 12 and guide member 14. Running tool 12 may be a cylindrical body made of hardened metal such as steel. Running tool 12 may include upper section 16, middle section 18, and lower section 20. The outer diameter ("OD") of running tool 12 may vary depending on the inner diameter ("ID") of the cased well bore that running tool 12 is positioned within. Running tool 12 may have an OD of 4½". Middle section 18 may contain window locator 22. Window locator 22 is substantially positioned internal of running tool 12. Head 24 of window locator 22 may be selectively movable and may extend external of running tool 12. A first internal bore (not shown) for passage of well-bore fluids extends through upper section 16. A second internal bore (not shown) for passage of well-bore fluids extends through lower section 20. Conduit 26 may fluidly connect the first internal bore in upper section 16 with the second internal bore in lower section 20. Conduit 26 may be any type of conduit capable of containing and flowing fluid there-through. Conduit 26 may be a supplementary internal bore in running tool 12. Conduit 26 may be hydraulic fluid tubing. Any number of tubing sizes may be used. For example, conduit 26 may have an OD of ½" and an ID of ⅜". Conduit 26 is necessary to bypass locator 22 which sets substantially internal of running tool 12. Conduit 26 may be covered by cover plate 140. While cover plate 140 is shown in one-piece, it is to be understood that cover plate 140 could be designed in separate pieces such as a two-piece or a three-piece design. Lower end 20 of running tool 12 contains cut-away portion 28. Cut-away portion 28 includes an outer surface 30 with a convex profile.

With reference to FIGS. 1 and 2, guide member 14 may be a cylindrical body made of hardened metal such as steel. Guide member 14 may include upper section 32, middle section 34, and lower section 36. The OD of guide member 14 may vary depending on the inner diameter of the cased well bore guide member 14 is positioned within. Guide member 14 may have an OD of 4½" particularly at lower section 36. An internal bore (not shown) may extend through guide member 14 from middle section 34 through lower section 36. The internal bore in guide member 14 may be in fluid communication with the internal bores and conduit 26 of running tool 12. Guide member 14 may have cutaway portion 38. Cut-away portion 38 may include outer surface 40 having a substantially concave profile. Outer surface 40 may extend from upper section 32, through middle section 34, to lower section 36. Outer surface 40 may terminate at lower section 36 or preferably at the beginning of lower section 36. Cut-away portion 40 may be tapered, inclined, or wedge-shaped, the thickness of cut-away portion 40 being less at upper section 32 of guide member 14 and gradually having a greater thickness in the middle section 34 and lower section 36 of guide member 14.

Again with reference to FIGS. 1 and 2, running tool 12 may be detachably secured to guide member 14. For instance, lower section 20 of running tool 12 may be detachably secured to upper section 32 of guide member 14. Preferably, cut-away portion 28 of running tool 12 may be detachably secured to portion 138 of cut-away portion 38 in upper section 32 of guide member 14. The convex profile of outer surface 30 of running tool 12 may cooperatively engage or mate with the concave profile of outer surface 40 of guide member 14. Running tool 12 and guide member 14 may be detachably secured by one or more securing means such as shear bolt 42. Running tool 12 and guide member 14 may also be detachably secured by a dove-tail joint (not shown). Guide member 14 may also include a retrieval slot 116 for fishing and retrieval of guide member 14.

As seen in FIG. 2, running tool 12 includes stinger pipe 44. Stinger pipe 44 has upper end 46 threadedly connected to lower section 20 of running tool 12. Upper end 46 may be threadedly connected to the end of the inner bore in lower section 20 of running tool 12. Lower end 48 of stinger pipe 44 is sealingly stung into the upper end of the internal bore in middle section 34 of guide member 14. This enables lower end 48 of stinger pipe 44 to slip out of or disengage from guide member 14 when running tool 12 is disconnected from guide member 14. Stinger pipe 44 provides fluid communication between the internal bores and conduit 26 of running tool 12 and the internal bore of guide member 14. Stinger pipe 44 may be any diameter depending on the ID of the internal bores in running tool 12 and guide member 14 and/or the desired volume and velocity of fluid to be communicated through pipe 44 to guide member 14 or any additional subs operatively connected to guide member 14. The length of stinger pipe 44 may depend on the distance required to provide fluid communication between running tool 12 and guide member 14. Stinger pipe may be 1" NPT stinger pipe. Upper and lower ends 46, 48 of stinger pipe 44 may contain an o-ring nose for detachably sealing with the internal bore in lower section 20 of running tool 12 and guide member 14, respectively.

Figure 3:
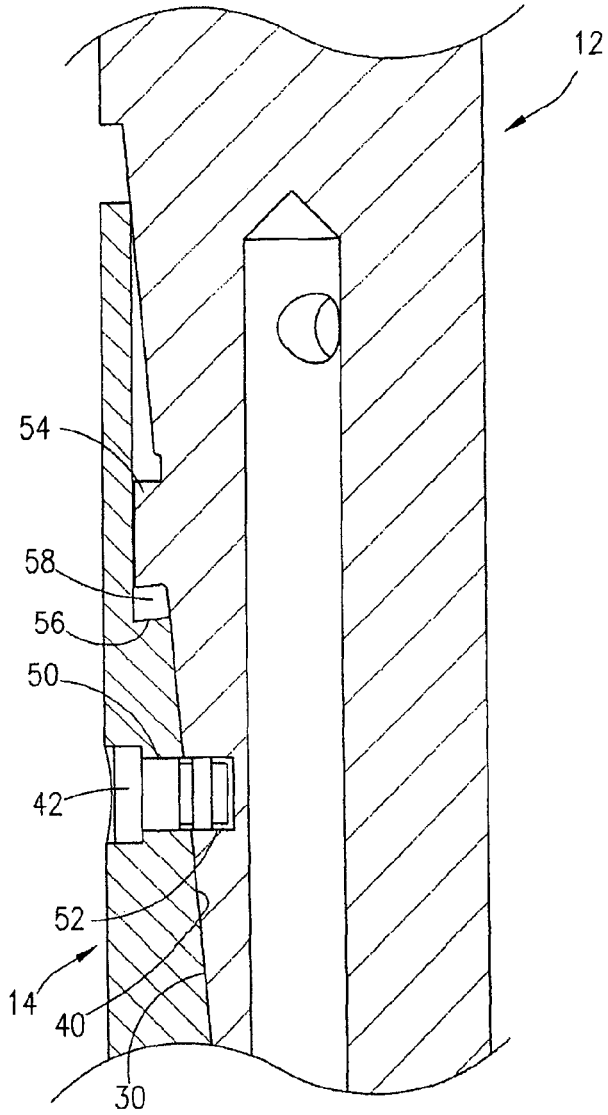
FIG. 3 is a cross-sectional partial view of the dovetail and shear bolt connecting the running tool and guide member components of the down-hole assembly.

FIG. 3 shows the detachable connection between running tool 12 and guide member 14. Shear bolt 42 is shown in a securing position. Shear bolt 42 sets within recess 50 in guide member 14 and recess 52 in running tool 12. Shear bolt 42 is designed to shear at a predetermined force. The predetermined shearing force may vary depending on the equipment used in the operation. Shear bolt 42 may be a 5½" X-1 shear bolt. Shear bolt 42 may shear at forces from 15 K to 28 K. Shear force can be reduced when down-hole assembly 10 is run with coiled tubing, which requires an upward shearing force. When shear bolt 42 is sheared, running tool 12 substantially disconnects or detaches from guide member 14 permitting running tool 12 and stinger pipe 44 to be pulled out of the cased well bore. For a variety of safety and operational reasons, the dovetail joint between running tool 12 and guide means 14 is provided. The dovetail joint includes first dovetail member 54 in running tool 12 and second dovetail member 56 in guide member 14. Gap 58 may be provided between first dovetail member 54 and second dovetail member 56. The size of gap 58 may vary. Gap 58 may be sized so as to permit ⅝" travel of first dovetail 54 relative to second dove tail 56. The dovetail joint between running tool 12 and guide member 14 prevents running tool 12 from going into a window in the cased well bore after shear bolt 42 has been sheared. The dovetail joint also prevents wedging between running tool 12 and guide member 14, which keeps any anchoring means from being pulled or released prematurely. The dovetail joint further prevents stinger pipe 44 from coming out of line with the seal of the internal bore in guide member 14 before removal is desired. When running a window finder job with pipe, the dovetail joint will permit weight to be set on any anchoring means being used. FIG. 3 also shows the internal fluid passage bore in lower end 20 of running tool 12.

Figure 4:
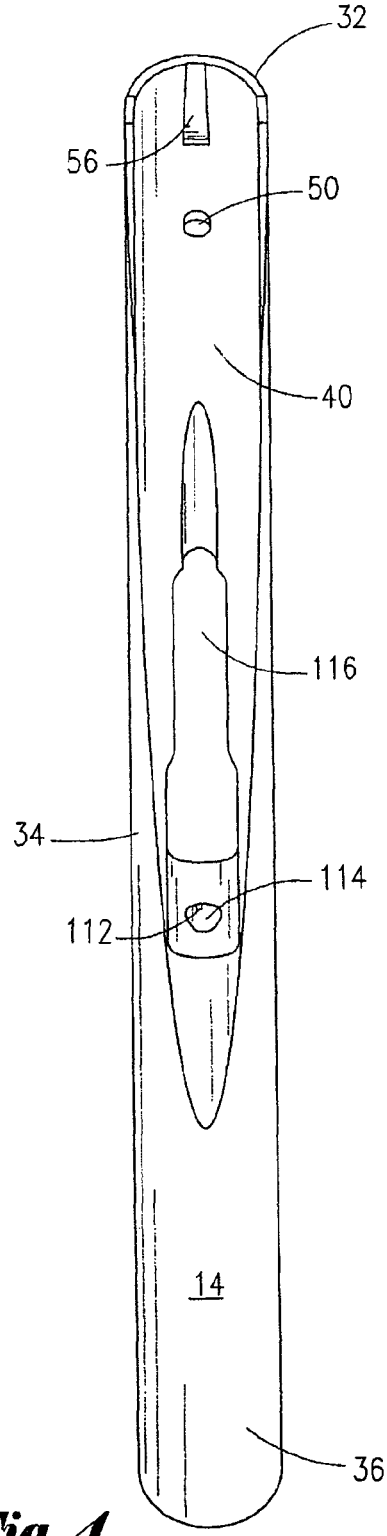
FIG. 4 is a side view of the guide member component of the down-hole assembly.

FIG. 4 illustrates guide member 14 without attachment of running tool 12 and stinger pipe 44. Guide member 14 has dovetail member 56, which provides a slot to receive and engage dovetail member 54 in running tool 12. Recess 50 for placement of shear bolt 42 is shown. Seal bore opening 112 is positioned in guide member 14. Opening 112 sealingly receives lower end 48 of stinger pipe 44. Internal bore 114 is shown. Bore 114 extends through middle section 34 and lower section 36 of guide member 14. The dovetail slot in dovetail member 56, as well as opening 112, are sized so as not to provide an attachment means for the fishing tool that removes guide member 14 from the well bore. Guide member 14 may have retrieval slot 116 that provides the attachment means for the retrieval or fishing tool used to remove guide member 14 from the well bore. Slot 116 may be configured to receive a hook on the fishing or retrieval tool.

Figure 5:
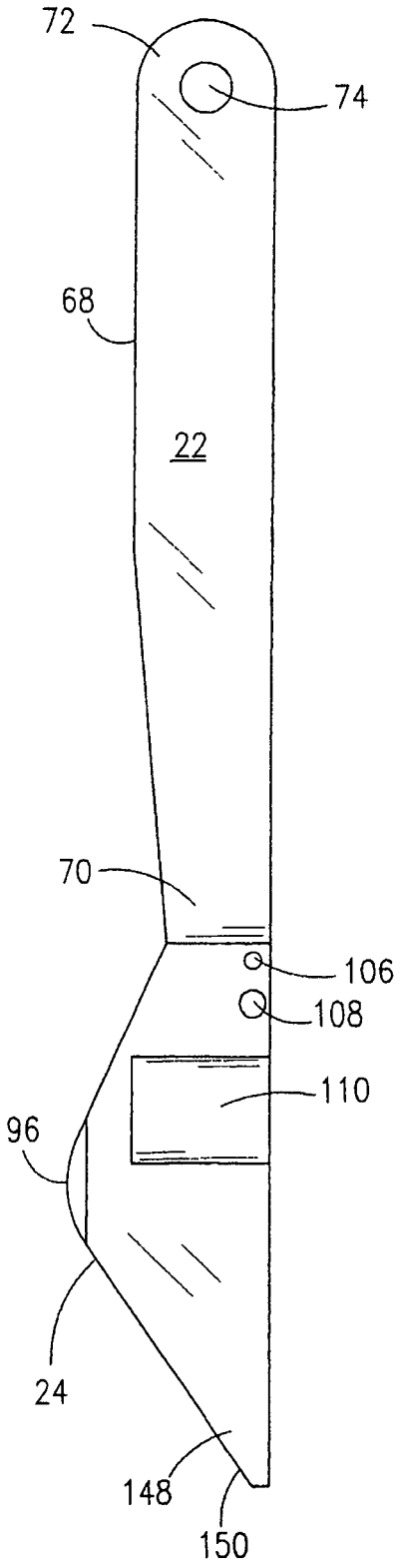
FIG. 5 is a side view of the window locator component of the down-hole assembly.
Figure 6:
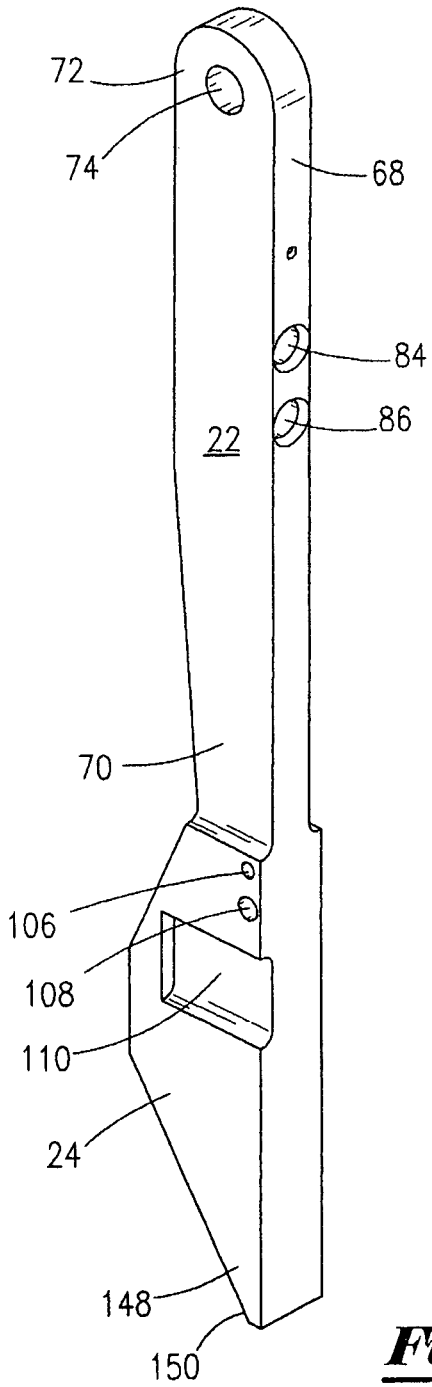
FIG. 6 is a perspective view of the window locator component of the down-hole assembly shown in FIG. 5.
Figure 7:
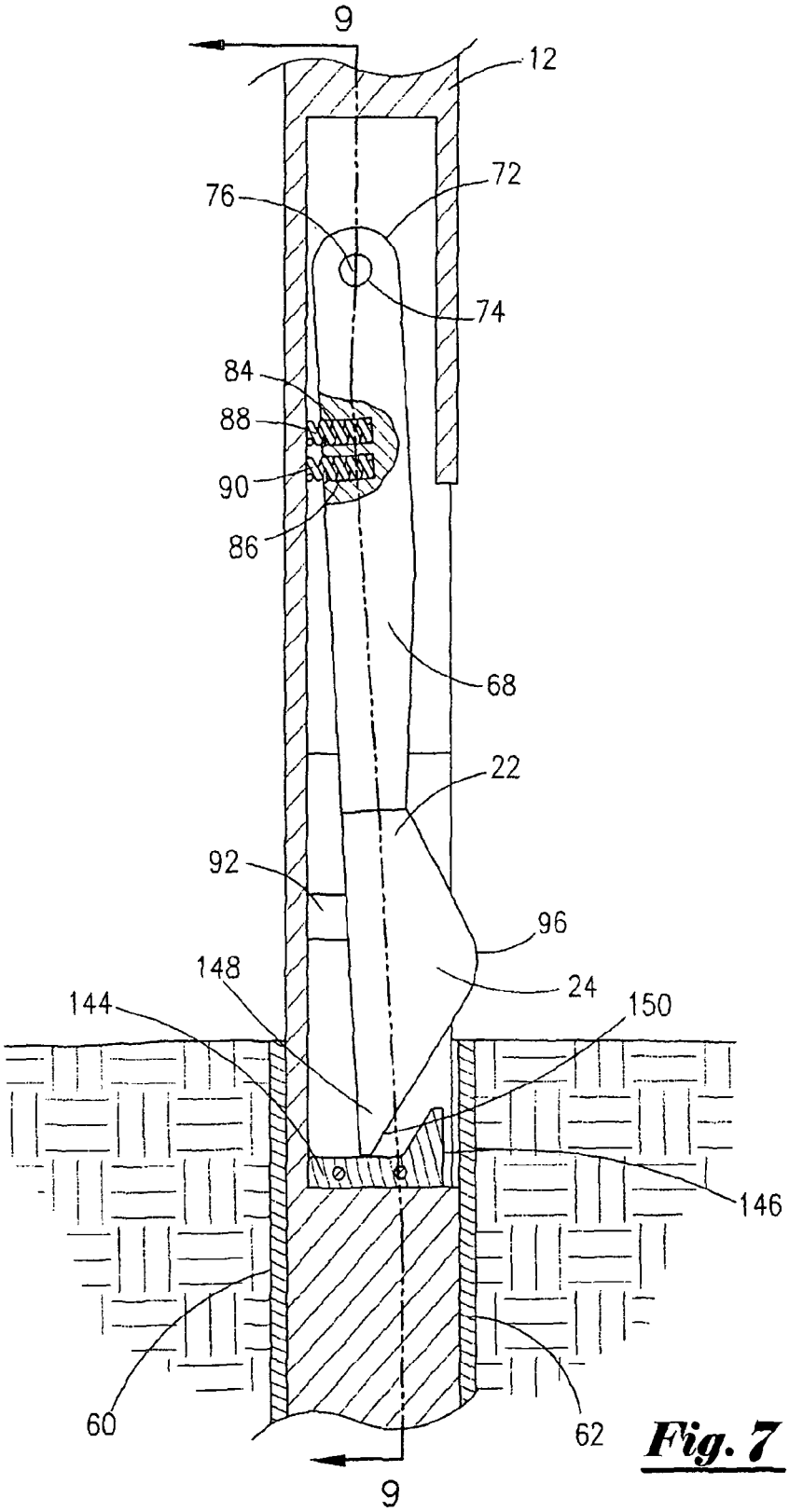
FIG. 7 is a partial cross-sectional side view of the running tool component of the down-hole assembly with the window locator in a run-in position.

As shown in FIGS. 5-7, window locator 22 may include pivot arm 68 with proximal end 70 and distal end 72. Head 24 may be connected to pivot arm 68 at distal end 70. Head 24 may be generally triangular-shaped with apex 96. Head 24 includes proximal end 148. Proximal end 148 has outer edge surface 150. Head 24 and pivot arm 68 may be a unitary piece. Window locator 22 may be made of hardened metal such as steel. Proximal end 72 of pivot arm 68 may contain pivot hole 74. Hinge pin 76 may be placed within pivot hole 74 and secured to running tool 12 in order to maintain the positioning of proximal end 72 relative to running tool 12 and act as a pivot point for window locator 22.

Again with reference to FIGS. 5-7, pivot arm 68 may contain recesses 84, 86. Biasing means 88, 90 may be positioned in recesses 84, 86, respectively. Biasing means 88, 90 may be springs. Although shown with two biasing means 88, 90, it is to be understood that running tool 12 could have one biasing means or three or more biasing means depending on the size and strength of the biasing means and/or the size and configuration of window locator 22. For example, seven biasing means may be provided with seven corresponding recesses to house the biasing means. Biasing means 88, 90 bias window locator 22 in an outward or external direction relative to a central longitudinal axis extending through running tool 12. Head 24 pivots or swings away from and external to the outer housing of running tool 12 unless otherwise held in place within running tool 12. Head 24 may contain recess 110 that may cooperate with the upper end of housing 92. Recess 110 may act as a guide for head 24 as head 24 pivots outward or inward relative to the outer housing of running tool 12.

Figure 8:
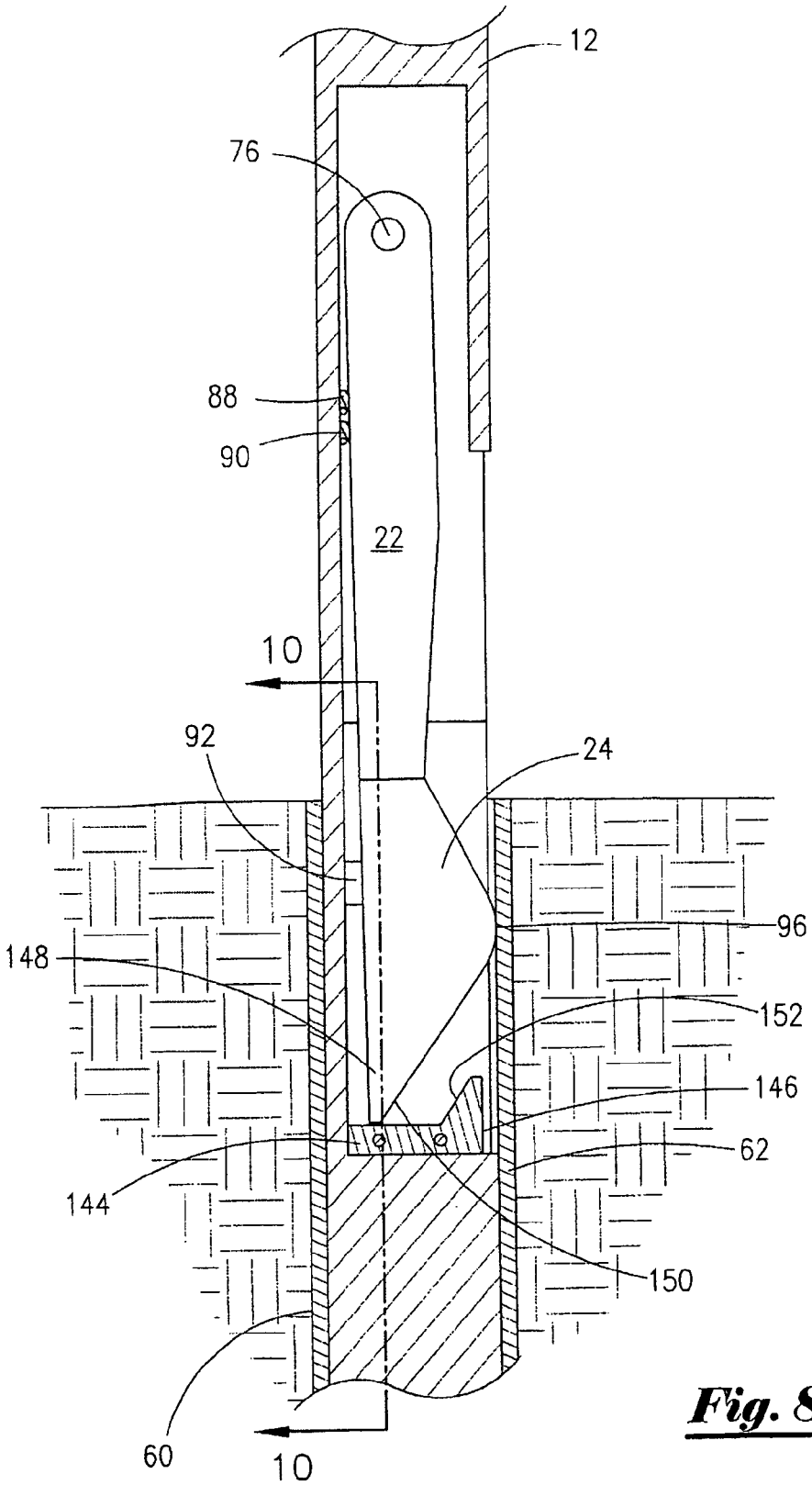
FIG. 8 is a partial cross-sectional side view of the running tool component of the down-hole assembly with the window locator in a retracted position.
Figure 11:
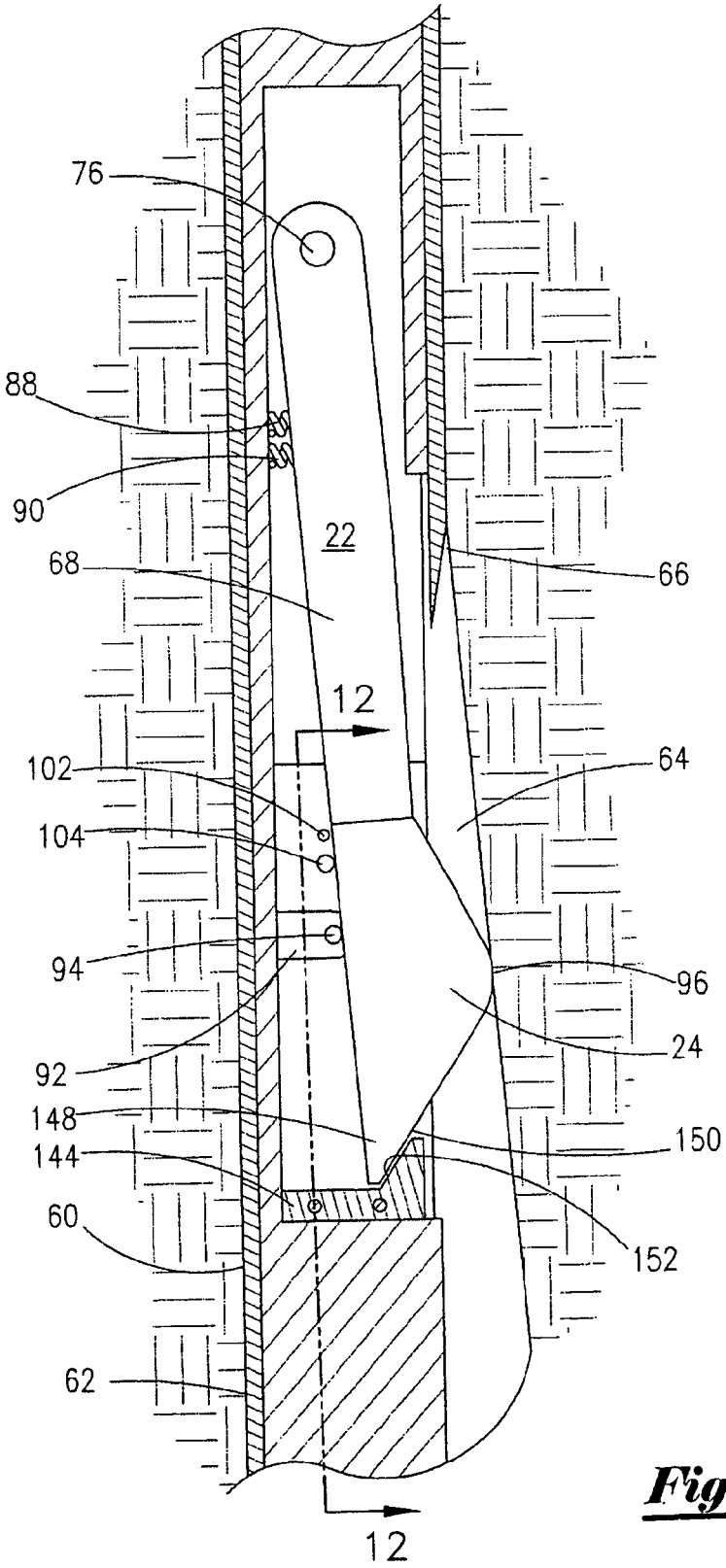
FIG. 11 is a partial cross-sectional side view of the running tool component of the down-hole assembly with the window locator in a window locating position.

As shown in FIGS. 7, 8 and 11, running tool 12 may include block 144. Block 144 may be positioned internal of running tool 12 and in operative association with window locator 22. Block 144 may be L-shaped with shoulder 146. Shoulder 146 may be adapted to receive window head 24 of window locator 22 to thereby restrict the maximum outward pivoting angle of window locator 22. Head 24 of window locator 22 may only pivot outwardly (external to running tool 12) to a point where outer edge surface 150 of proximal end 148 of head 24 abuts surface 152 of shoulder 146 of block 144. Block 144 therefore acts as a stop for the outward pivoting of window locator 22. Block 144 may be made of hardened metal such as steel. Block 144 may be affixed to running tool 12 by any fixation means such as a pin in which case both block 144 and running tool 12 would have a recess to receive the pin. One or more pins may be used to affix block 144 to running tool 12. For example, two pins may be used to affix block 144 to running tool 12. Both block 144 and running tool 12 would each have two recesses to receive the respective two pins. While shown as a separate piece, it is to be understood that block 144 could be made integral with running tool 12.

Figure 9:
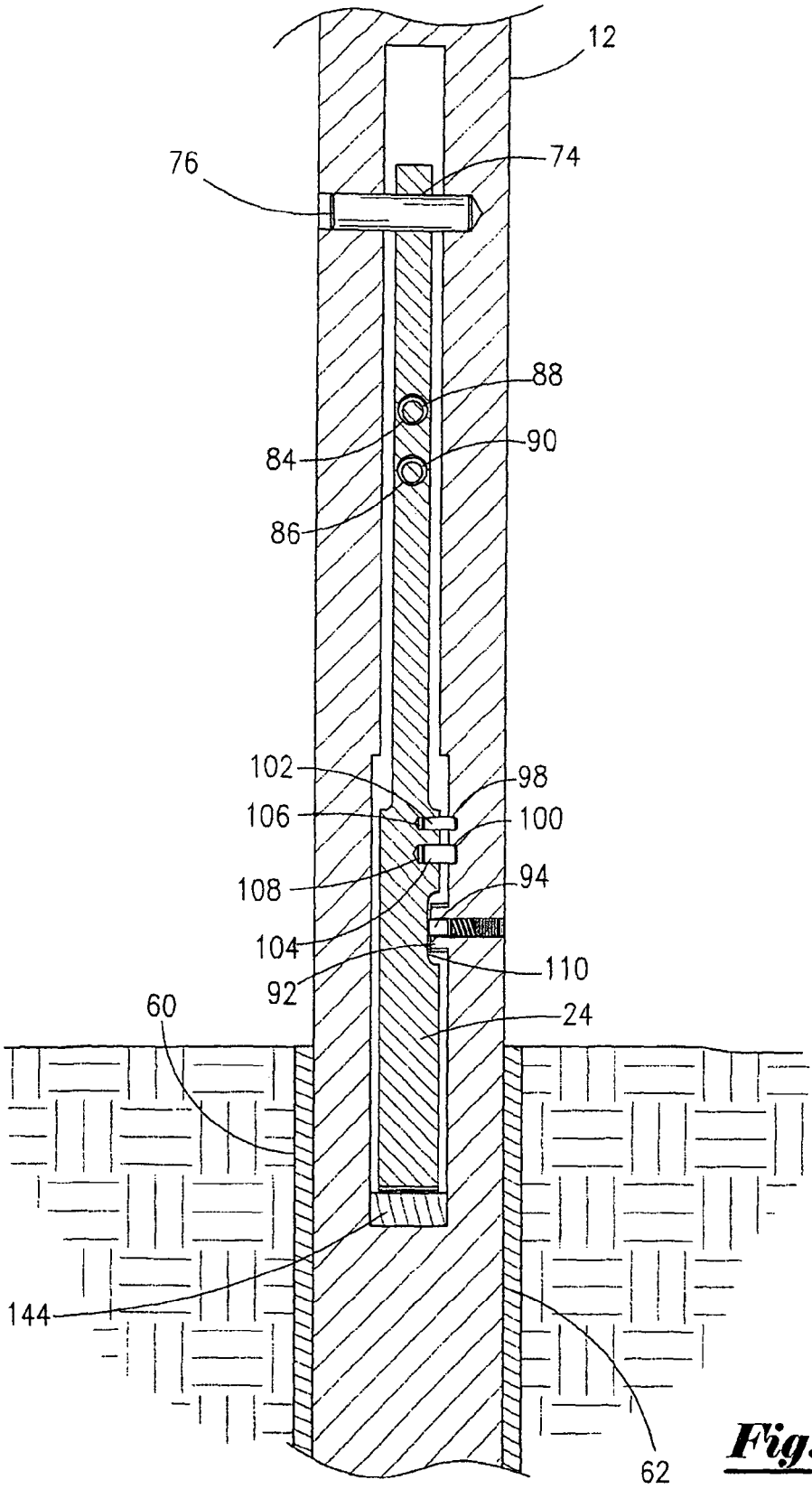
FIG. 9 is a partial cross-sectional side view of the running tool component of the down-hole assembly taken along line 9-9 of FIG. 7.

FIGS. 7 and 9 illustrate window locator 22, and more particularly, head 24, in a run-in position. Running tool 12 may contain recesses 98, 100. Recesses 98, 100 may contain shear pins 102, 104, respectively. Head 24 contains cooperating recesses 106, 108. When down-hole assembly 10 is first assembled for operation, shear pins 102, 104 hold head 24 in a stationary position. Head 24 may be held stationary at an OD of 5½" based on a cross-sectional measurement of running tool 12. Head 24 is held stationary because the proximal end of shear pins 102, 104 are set within recesses 98, 100, respectively, and the distal ends of shear pins 102, 104 are set within recesses 106, 108, respectively. When down-hole assembly 10 is run down well bore 60, assembly 10 may reach casing or tubing 62 having an inner bore wall with an ID greater than the OD of running tool 12 at apex 96 of head 24 (e.g., ID smaller than 5½"). Head 24 will contact the larger ID of the inner casing wall. Due to the downward force being applied to down-hole assembly 10, head 24 will be forced inward causing shear pins 102, 104 to shear thereby freeing window locator 22 from its stationary position. Window locator 22 is now free to pivot respective to the pivot point at pivot hole 74. Shear pins 102, 104 may be sized the same so that both shear at the same predetermined force. Alternatively, shear pins 102, 104 could be sized differently and therefore shear at different forces. Depending on the work string weight, only one shear pin 102 or 104 could be used in running tool 12; its size determined by the particular work string weight and amount of force capable of being generated to shear either shear pin 102 or 104. Moreover, running tool 12 could be provided with more than two shear pins 102, 104. For example, running tool 12 could have two additional shear pins 102, 104 (not shown) and corresponding recesses 98, 100 (not shown) positioned directly opposite shear pins 102, 104 and recesses 98, 100 shown in FIG. 7. The two additional shear pins 102, 104 could be sized the same so that both shear at the same predetermined force. Alternatively, additional shear pins 102, 104 could be sized differently and therefore shear at different forces. By including four shear pins, a wider range of shear values is achieved. One or more of the four shear pins 102, 104 could be used based on the work string weight that generates the shearing force.

Figure 10:
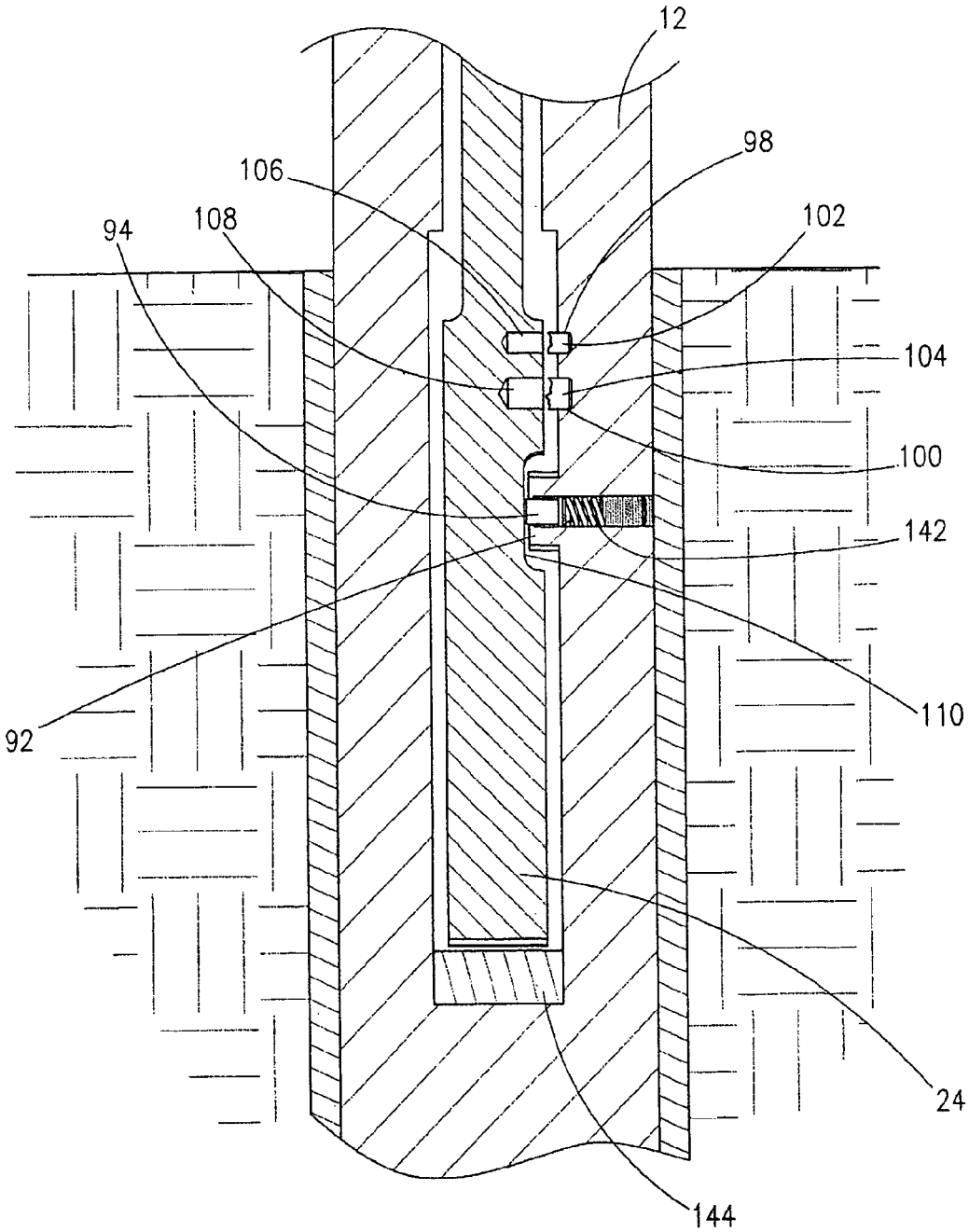
FIG. 10 is a partial cross-sectional side view of the running tool component of the down-hole assembly taken along line 10-10 of FIG. 8.

FIGS. 8 and 10 show window locator 22, and more particularly head 24, in its retracted position after shear pins 102, 104 have been sheared due to retraction forces applied to head 24 by the smaller ID inner wall of casing 62. Although window locator 22 is biased outward, the inner wall of casing 62 prevents head 24 from pivoting in a direction external of running tool 12. Head 24 covers the recess in housing 92 that contains movable shear pin 94 until actuated as described below. Movable shear pin 94 may be a spring loaded shear pin. Biasing means 142 bias shear pin 94. Biasing means 142 may be a spring.

Figure 12:
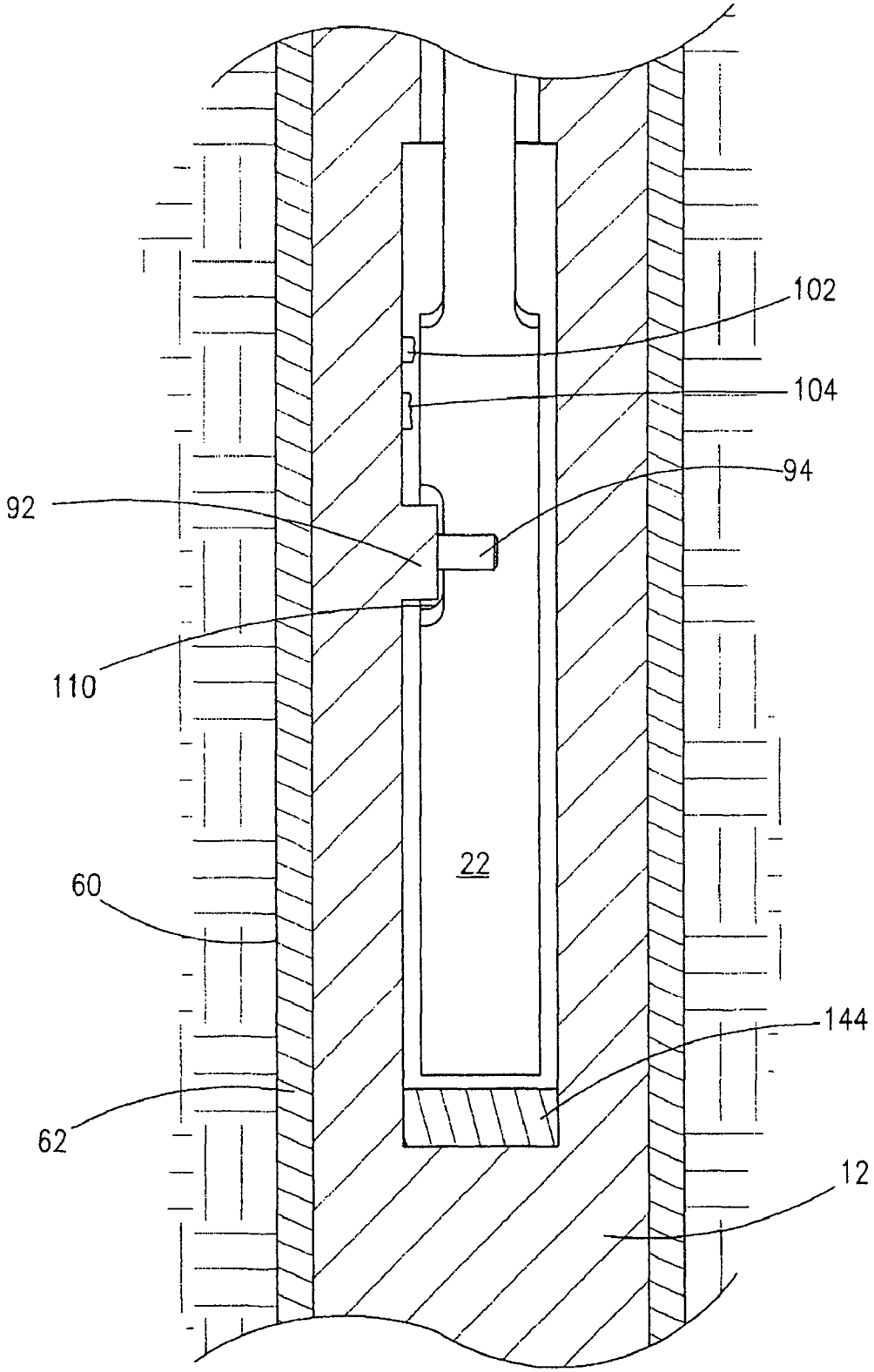
FIG. 12 is a partial cross-sectional side view of the running tool component of the down-hole assembly taken along line 12-12 of FIG. 11.

FIGS. 11 and 12 show window locator 22, and more particularly window locating head 24, in its window locating position. As previously mentioned, biasing means 88, 90 bias head 24 of window locator 22 outwardly and in a direction external of running tool. As down-hole assembly 10 is run down-hole, apex 96 of head 24 is biased against the inner bore wall of casing 62 (FIG. 8). When window locator 22 encounters window 64, a portion of window locating head 24 is biased into window 64 achieving its fully extended or window locating position (e.g., 6⅜" OD). Once head 24 swings outwardly and external to the outer housing of running tool 12 past a predetermined point, head 24 may be temporarily prevented from moving back or retracting into running tool 12 by the expansion of shear pin 94. The expansion of shear pin 94 takes place when head 24 swings past the recess in housing 92. Biasing means 142 expand and force shear pin 94 to an extended position sufficient to impede head 24 from pivoting backward into running tool 12. Shear pin 94 may extend out of the recess in housing 92 by about ⅜" to act as a backstop for head 24. Shear pin 94 may be a spring loaded 10K shear pin. Preferably, housing 92 and shear pin 94 are positioned such that shear pin 94 expands to its stop position when apex 96 of head 24 reaches an OD of 6⅜" based on a cross-sectional measurement of running tool 12. Shear pin 94 is designed so that when a predetermined amount of force is applied during the removal of running tool 12 from well bore 60 after dislodgment from guide member 14, shear pin 94 will shear thereby permitting head 24 of window locator 22 to pivot back into or towards running tool 12 and return to its retracted position for removal from well bore 60. While shown with one shear pin 94, it is to be understood that more than one shear pin 94 may be used. For example, two shear pins 94 could be provided with respective biasing means 142 associated therewith in respective recesses.

Figure 13A:
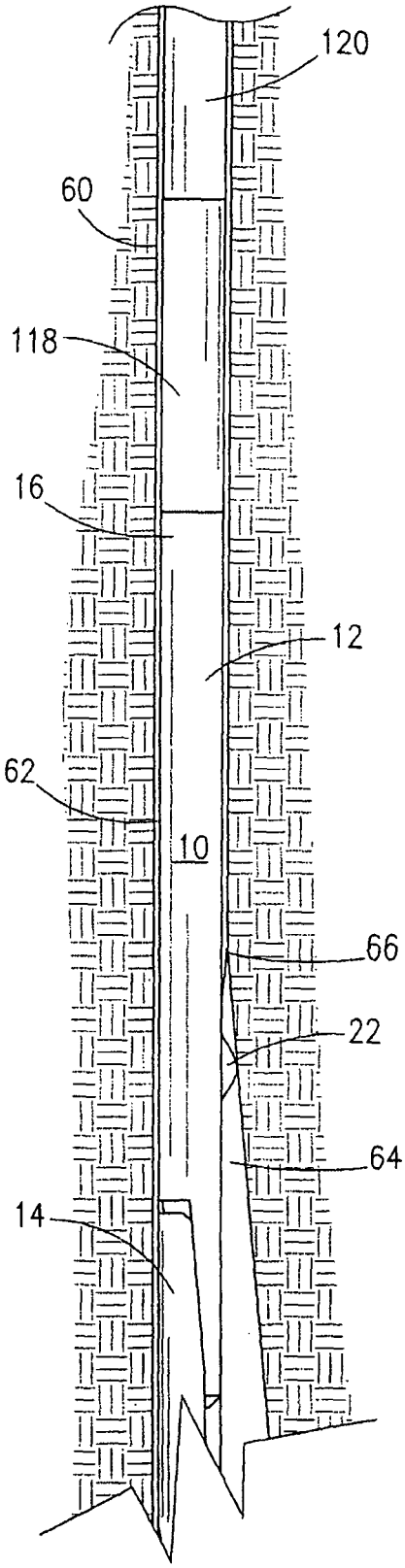
FIGS. 13A and 13B are a sequential side view of the down-hole assembly deployed in a main well bore with the window locator in a window locating position.
Figure 13B:
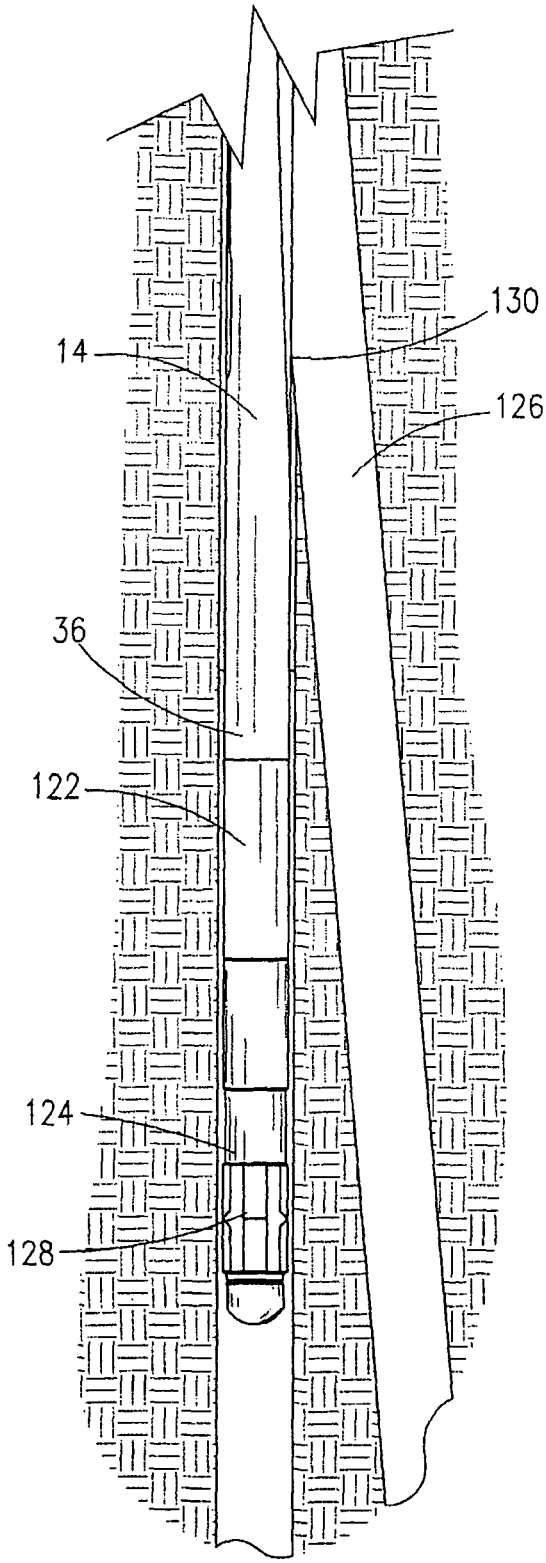

FIGS. 13A and 13B illustrate down-hole assembly 10 run in main well bore 60 to a position adjacent window 64. Main well bore 60 may be a vertical, horizontal or deviated well. Window 64 begins at upper edge 66 and ends at lower edge 130, which is the point where lateral well bore 126 begins. Window locator 22 is shown with head 24 in its fully extended or window locating position external to the outer housing of running tool 12 and within window 64. Down-hole assembly 10 includes diverter sub 118 operatively connected to running tool 12. Diverter sub 118 may be threadedly connected to upper section 16 of running tool 12. Diverter sub 118 is commercially available from RT Manufacturing under model name FD-287. The upper end of diverter sub is operatively connected to tubular 120. Tubular 120 may be a work string such as drill pipe or coiled tubing. In the case of coiled tubing, an indexing tool may be operatively connected to diverter sub 118. The indexing tool is commercially available from RT Manufacturing under model name IT-412.

As revealed in FIGS. 13A and 13B, down-hole assembly 10 further includes debris sub 122 operatively connected to guide member 14. Debris sub 122 may be threadedly connected to lower section 36 of guide member 14. Debris sub 122 is commercially available from Knight Fishing Services under model name SUBEXD350IF.

As also shown in FIGS. 13A and 13B, down-hole assembly 10 may also include anchor sub 124 operative connected to debris sub 122. Anchor sub 124 may be threadedly connected to the lower end of debris sub 122. Anchor sub 124 may contain anchoring means to detachably secure down-hole assembly 10 within well bore 60 at a desired location. Such desired location may be the location where guide member 14 is adjacent to window 64 leading into lateral well bore 126. The anchoring means of anchor sub 124 may be one or more slips 128 such as hydraulically activated slips. Anchor sub 124 is commercially available from RT Manufacturing under model name ACH550.

With reference to FIGS. 13A and 13B, as down-hole assembly 10 is run down well bore 60, window locator 22 is placed adjacent to window 64. Head 24 is no longer restricted by the inner bore wall of casing 62 of well bore 60 and therefore is biased to its maximum pivoting radius and is prevented from retreating back into running tool by shear pin 94. Window locator 22 is locked in place. This allows weight to be applied in either an upward or downward direction. When assembly 10 is pulled upward, head 24 will encounter point 66 which signals the beginning of window 64. When assembly 10 is pushed downward, head 24 will encounter lower edge 130 which signals to bottom edge of window 64 where lateral well bore 126 commences. Accordingly, the operator is able to determine the location of window 64 in well bore 60 as well as its dimensions. The operator is now able to position assembly 10 at a point where guide member 14 will cause the diversion of a tubular (e.g., a work string containing a milling or drilling bit) into lateral well bore 126.

Again with reference to FIGS. 13A and 13B, with assembly 10 and more particularly guide member 14 in position, the operator will activate anchor sub 124 to set slips 128. Slips 128 may be activated in a variety of ways. Slips 128 may be activated by hydraulic fluid pressuring a piston in anchor sub 124 to set slips 128 against the inner wall of casing 62 in well bore 60. The hydraulic fluid pressure may be supplied to anchor sub 124 by fluid pressure contained within assembly 10. Assembly 10 may have a fluid path running therethrough. For example, an internal bore in diverter sub 118 may be in fluid communication with the first internal bore in upper section 16 of running tool 12, which in turn is in fluid communication with the second internal bore in lower section 26 of running tool 12 via conduit 26. The second internal bore in lower section 26 of running tool 12 is in fluid communication with the internal bore extending through guide means 14 via stinger pipe 44. The internal bore in guide member 14 is in fluid communication with an internal bore in debris sub 122, which in turn is in fluid communication with an internal bore in anchor sub 124. Thus, fluid pressure may be pressured up to reach a predetermined pressure sufficient to activate slips 128. Diverter sub 118 may include a ball or dart valve seat. Increasing the fluid pressure for activation of slips 128 may require that a ball or dart be dropped from the well surface through tubular 120 to diverter sub 118 where the ball or dart sets in the valve seat of diverter sub 118 to close and divert fluid passage through the valve so that anchor sub 124 may be activated to place slips 128 in their anchoring position. This operation is well known to one of ordinary skill in the art.

Figure 14A:
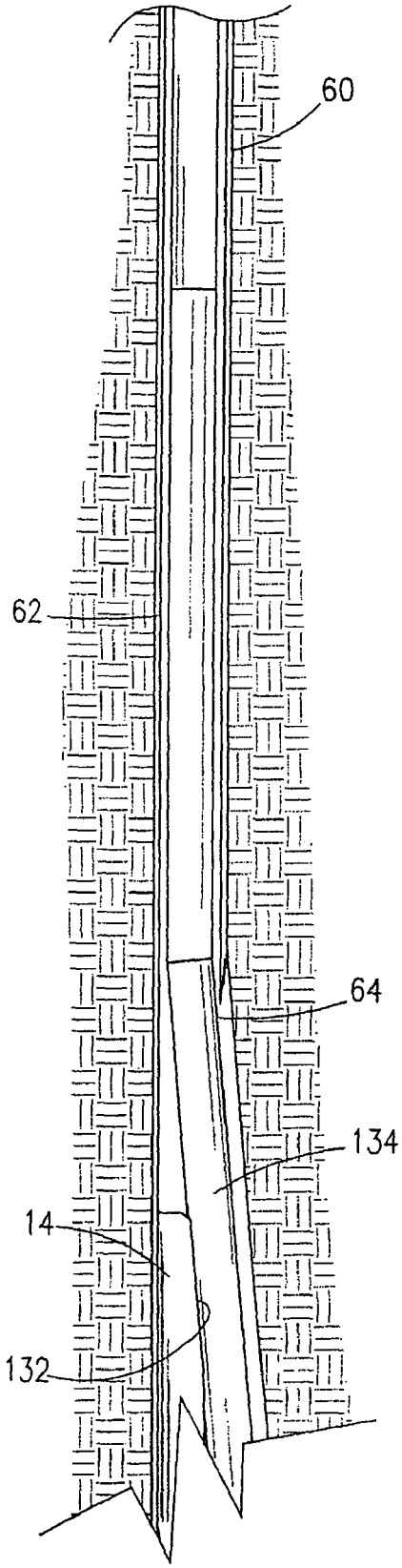
FIGS. 14A and 14B are a sequential side view of the guide member component of the down-hole assembly in an operational and anchored position in a main well bore.
Figure 14B:
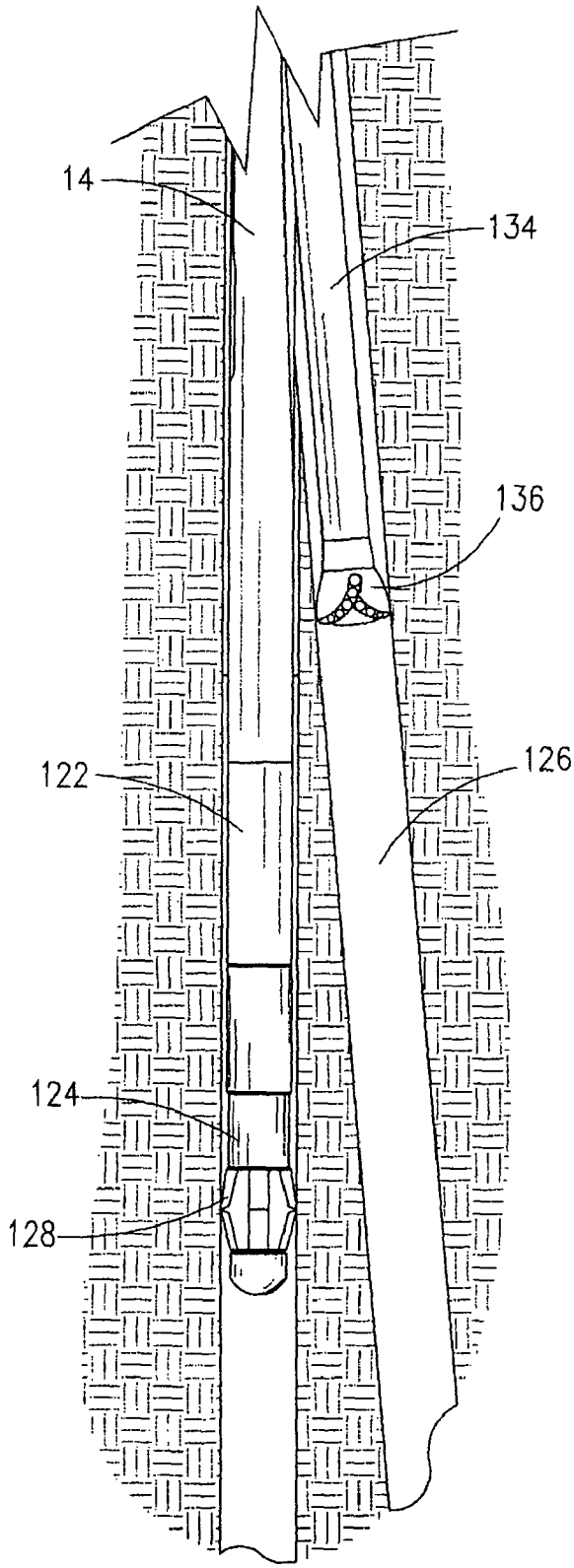

With reference to FIGS. 14A and 14B, after slips 128 are set, running tool 12 is released from guide member 14. A downward force is applied to running tool 12 (or an upward force in the case where tubular 120 is coiled tubing) sufficient to shear bolt 42. The assembly of diverter sub 118, running tool 12, and stinger pipe 44 is dislodged from guide member 14 and pulled out of well bore 60 leaving the assembly of guide member 14, debris sub 122 and anchor sub 124 positioned in well bore 60. Guide member 14 includes inclined or wedge shaped surface 132, which acts to divert or direct a tubular, such as tubular 134 containing milling bit 136, into window 64 and/or lateral well bore 126. Guide member 14 (namely inclined or wedged shaped surface 132) guides various equipment in and out of window 64 and/or lateral well bore 126 in order to carryout a variety of operations. For example, lateral well bore 126 may be cleaned out to restore production. Lateral well bore 126 may be re-drilled. A liner may be installed in lateral well bore 126. Other remedial work requiring a guide in and out of lateral well bore 126 may be performed.

After completion of the work, the assembly of guide member 14, debris sub 122 and anchor sub 124 may be removed from well bore 60. A retrieval or fishing tool may be sent down well bore 60 to retrieve the assembly. Such retrieval tools are commercially available from Knight Fishing Services under model name 7"STANDARDDWHSTK-RETHK.

The fishing tool may have a retrieving device such as a hook that connects to retrieval slot 116 in guide member 114. Once connected, the fishing tool, together with the assembly of guide member 14, debris sub 122 and anchor sub 124, would be extracted or pulled out of well bore 60. Slips 128 would disengage from the inner wall of the casing in well bore 60 due to sufficient pulling force being applied to anchor sub 124.

While preferred embodiments of the present invention have been described, it is to be understood that the embodiments described are illustrative only and that the scope of the invention is to be defined solely by the appended claims when accorded a full range of equivalents, many variations and modifications naturally occurring to those skilled in the art from a perusal hereof.

What is claimed is:

1. A down-hole assembly for locating a window and reentering a lateral well bore in a main well bore after removal of a whip stock, comprising:

a running tool having an upper section, a middle section and a lower section, said running tool including a window locator for locating said window, said window locator comprising a pivoting arm and a window locating head;

a guide member having an upper section, a middle section and a lower section, said guide member having a wedged-shaped outer surface for diverting a down-hole tool through said window and into said lateral well bore;

wherein said lower section of said running tool and said upper section of said guide member are each shaped to receive the other in mating relationship;

wherein said lower section of said running tool and said upper section of said guide member are capable of being detachably connected, and when detachably connected, said running tool and said guide member are in fluid communication;

wherein said window locating head has a run-in position, a retracted position, and a window locating position and wherein in said window locating position, said window locating head is biased in a direction external to said running tool and a portion of said window locating head is positioned within said window; and wherein said running tool includes a stop means for preventing retraction of said window locating head from said window locating position to enable determination of an upper edge of said window by pulling upward on said tool and of a lower edge of said window by pushing downward on said tool.

2. The down-hole assembly according to claim 1, wherein said running tool includes a biasing means operatively associated with said window locator, said biasing means exerting a force on said pivoting arm of said window locator to bias said window locating head in a direction external of said running tool.

3. The down-hole assembly according to claim 1, wherein in said run-in position, said window locating head is positioned between said retracted and said window locating positions and held stationary.

4. The down-hole assembly according to claim 3, wherein said running tool includes one or more shear pins affixed to said window locator, said shear pins maintaining said window locating head in said stationary position until sheared.

5. The down-hole assembly according to claim 1, wherein in said retracted position, said window locating head is positioned substantially within said running tool, said window locating head being held in said retracted position by said main well bore.

6. The down-hole assembly according to claim 1, wherein said running tool includes a block means for restricting a maximum outward pivoting angle of said window locating head.

7. The down-hole assembly according to claim 6, wherein said block means includes a shoulder capable of receiving an outer edge surface of said window locating head.

8. The down-hole assembly according to claim 1, wherein said stop means comprise one or more spring-loaded shear pins, said one or more spring loaded shear pins being actuated by displacement of said window locating head from said retracted position to said window locating position and deactivated by a shearing force, said deactivation resulting in said window locating head returning to said retracted position.

9. The down-hole assembly according to claim 1, wherein said upper section of said running tool has a first internal fluid passage bore and said lower section of said running tool has a second internal fluid passage bore, said first and second internal fluid passage bores being fluidly connected by a conduit, said conduit by-passing said window locator.

10. The down-hole assembly according to claim 1, wherein said shape of said lower section of said running tool is convex and said shape of said upper section of said guide member is concave.

11. The down-hole assembly according to claim 1, wherein said lower section of said running tool and said upper section of said guide member are detachably connected by a shear bolt.

12. The down-hole assembly according to claim 11, wherein said lower section of said running tool and said upper section of said guide member are further detachably connected by a dovetail joint.

13. The down-hole assembly according to claim 1, wherein said guide member includes an internal fluid passage bore and said running tool includes a stinger pipe fluidly connected to a second internal fluid passage bore, said stinger pipe being sealingly connected to said internal fluid passage bore of said guide member when said running tool and said guide member are detachably connected.

14. The down-hole assembly according to claim 1, wherein said guide member includes a retrieval means, said retrieval means providing a point of operative attachment for a fishing tool.

15. A down-hole assembly for locating a window and reentering a lateral well bore in a main cased well bore after removal of a whip stock, comprising:

a diverter sub having an upper end and a lower end, said upper end of said diverter sub being operatively connected to a tubular;

a running tool having an upper section, a middle section and a lower section, said upper section of said running tool being operatively connected to said lower end of said diverter sub, said running tool including a window locator for locating said window, said window locator comprises a pivoting arm and a window locating head, said upper section of said running tool including a first internal fluid passage bore, said lower section of said running tool including a second internal fluid passage bore, said running tool including a conduit fluidly connecting said first and second internal fluid passage bores;

a guide member having an upper section, a middle section and a lower section, said lower section of said running tool and said upper section of said guide member are each shaped to receive the other in mating relationship, said guide member having an internal fluid passage bore, said upper section of said guide member being detachably connected to said lower section of said running tool, said guide member having a wedged-shaped outer surface for diverting a down-hole tool through said window and into said lateral well bore;

a stinger pipe having an upper end and a lower end, said upper end of said stinger pipe being sealingly connected to said second internal fluid passage bore in said lower end of said running tool, said lower end of said stinger pipe being sealingly connected to said internal fluid passage bore of said guide member;

a debris sub having an upper end and a lower end, said upper end of said debris sub being operatively connected to said lower section of said guide member; said debris sub including an internal fluid passage bore in fluid communication with said internal fluid passage bore of said guide member;

an anchor sub having an upper end and a lower end, said upper end of said anchor sub being operatively connected to said lower end of said debris sub, said anchor sub including an internal fluid passage bore fluidly connected to said internal fluid passage bore of said debris sub, said anchor sub including anchor means for detachably affixing said anchor sub to said cased well bore;

wherein said window locating head has a run-in position, a retracted position, and a window locating position;

wherein said running tool includes a stop means for preventing retraction of said window locating head from said window locating position to enable determination of an upper edge of said window by pulling upward on said tool and of a lower edge of said window by pushing downward on said tool.

16. The down-hole assembly according to claim 15, wherein said tubular is a work string, drill pipe or coiled tubing.

17. The down-hole assembly according to claim 16, wherein said tubular is coiled tubing and wherein said down-hole assembly further comprises an indexing tool.

18. The down-hole assembly according to claim 15, wherein said running tool includes a biasing means operatively associated with said window locator, said biasing means exerting a force on said pivoting arm of said window locator to bias said window locating head in a direction external of said running tool.

19. The down-hole assembly according to claim 15, wherein in said run-in position, said window locating head is positioned between said retracted and said window locating positions and held stationary.

20. The down-hole assembly according to claim 19, wherein in said run-in position, said window locating head is partially positioned external of said running tool for engagement with said main cased well bore.

21. The down-hole assembly according to claim 15, wherein said shape of said lower section of said running tool is convex and said shape of said upper section of said guide member is concave.

22. The down-hole assembly according to claim 15, wherein said lower section of said running tool and said upper section of said guide member are detachably connected by a shear bolt.

23. The down-hole assembly according to claim 22, wherein said lower section of said running tool and said upper section of said guide member are further detachably connected by a dovetail joint.

24. The down-hole assembly according to claim 19, wherein said running tool includes one or more shear pins affixed to said window locator, said shear pins maintaining said window locating head in said stationary position until sheared.

25. The down-hole assembly according to claim 15, wherein in said retracted position, said window locating head is positioned substantially within said running tool, said window locating head being held in said retracted position by said main cased well bore.

26. The down-hole assembly according to claim 15, wherein in said window locating position, said window locating head is biased in a direction external to said running tool and a portion of said window locating head is positioned within said window.

27. The down-hole assembly according to claim 26, wherein said running tool includes a block means for restricting a maximum outward pivoting angle of said window locating head.

28. The down-hole assembly according to claim 27, wherein said block means is L-shaped and includes a shoulder capable of receiving an outer edge surface of said window locating head.

29. The down-hole assembly according to claim 15, wherein said stop means comprise one or more spring-loaded shear pins, said one or more spring loaded shear pins being actuated by displacement of said window locating head from said retracted position to said window locating position and deactivated by a shearing force, said deactivation resulting in said window locating head returning to said retracted position.

30. The down-hole assembly according to claim 15, wherein said guide member includes a retrieval means, said retrieval means providing a point of operative attachment for a fishing tool.

31. A method of locating a window and reentering a lateral well bore in a main well bore from which a whip stock has been removed, comprising the steps of:

(a) deploying a tubular down said main well bore, said tubular containing a down-hole assembly, said down-hole assembly including a running tool having an upper section, a middle section and a lower section, said running tool including a window locator for locating said window, said window locator comprising a pivoting arm and a window locating head; a guide member having an upper section, a middle section and a lower section, said guide member having a wedged-shaped outer surface for diverting a down-hole tool through said window and into said lateral well bore; wherein said lower section of said running tool and said upper section of said guide member are each shaped to receive the other in mating relationship; wherein said lower section of said running tool and said upper section of said guide member are capable of being detachably connected, and when detachably connected, said running tool and said guide member are in fluid communication; wherein said window locating head has a run-in position, a retracted position, and a window locating position and wherein in said window locating position, said window locating head is biased in a direction external to said running tool and a portion of said window locating head is positioned within said window; and wherein said running tool includes a stop means for preventing retraction of said window locating head from said window locating position to enable determination of an upper edge of said window by pulling upward on said tool and of a lower edge of said window by pushing downward on said tool;

(b) activating said window locator so that said window locator is able to reposition to a window locating position external to said running tool when said running tool is placed adjacent said window;

(c) causing said window locator to reposition to said window locating position by placing said running tool adjacent said window;

(d) maintaining said window locator in said window locating position;

(e) determining the upper edge of said window and the lower edge of said window;

(f) positioning said guide member adjacent said window;

(g) anchoring said guide member in said main well bore;

(h) detaching said running tool from said guide member;

(i) pulling said running tool out of said main well bore; and (j) deploying a second tubular containing said down-hole tool down said main well bore, through said window, and into said lateral well bore, said wedged-shaped outer surface of said guide member acting to divert said down-hole tool from said main well bore, through said window, and into said lateral well bore.

32. The method according to claim 31, further comprising the step of:

(k) causing said down-hole tool to perform remedial work on said lateral well bore.

33. The method according to claim 32, further comprising to steps of:

(l) removing the down-hole tool from the lateral well bore and the main well bore;

(m) deploying a third tubular containing a fishing tool down said main well bore;

(n) connecting said fishing tool to said guide member;

(o) disengaging said guide member from said main well bore; and (p) pulling said guide member out of said main well bore.

34. The method according to claim 31, wherein said main well bore is a cased well bore.

35. The method according to claim 31, wherein said tubular is a work string, drill pipe or coiled tubing.

36. The method according to claim 35, wherein said tubular is coiled tubing and wherein said down-hole assembly further comprises a indexing tool.

* * * * *